US006296511B1

(12) United States Patent
Tseng et al.

(10) Patent No.: US 6,296,511 B1
(45) Date of Patent: Oct. 2, 2001

(54) ELECTRICAL CONNECTOR

(75) Inventors: Gwou-Jong Tseng, Tu-Chen; Yuh-Huey Kang, Pan-Chiao, both of (TW)

(73) Assignee: Hon Hai Precision Ind. Co, Ltd., Taipei Hsien (TW)

( * ) Notice: Subject to any disclaimer, the term of this patent is extended or adjusted under 35 U.S.C. 154(b) by 0 days.

(21) Appl. No.: 09/387,890

(22) Filed: Sep. 1, 1999

(30) Foreign Application Priority Data

May 6, 1999 (TW) ..... 88207166

(51) Int. Cl.[7] ..... H01K 13/629
(52) U.S. Cl. ..... 439/377; 439/637
(58) Field of Search ..... 439/377, 637, 439/636

(56) References Cited

U.S. PATENT DOCUMENTS 5,433,616 * 7/1995 Walden ..... 439/637
5,511,985 * 4/1996 Noschese et al. ..... 439/377
5,542,854 * 8/1996 Bowen ..... 439/377
5,676,555 * 10/1997 Yu et al. ..... 439/157
5,690,499 * 11/1997 Howell et al. ..... 439/157

* cited by examiner

*Primary Examiner*—Gary Paumen
(74) *Attorney, Agent, or Firm*—Wei Te Chung

(57) ABSTRACT

An electrical connector for electrically connecting a card to a printed circuit board comprises an insulative housing, a number of contacts and a pair of board locks received in the housing, and a pair of card ejector mechanisms pivotally mounted in opposite ends of the housing. The housing defines a slot which separates a middle section thereof into a first part and a second part. The first and second parts each define a number of cavities in which the contacts are received. The first and second parts each provides a number of projections extending beyond an inner wall thereof. The projections on the first part are spaced a distance equal to a thickness of a daughter card inserted in the slot from the projections on the second part. The projections on the first and second parts abut against opposite surfaces of the daughter card thereby securing the daughter card in the housing.

1 Claim, 5 Drawing Sheets

ELECTRICAL CONNECTOR

BACKGROUND OF THE INVENTION

The present invention relates to a card edge connector, and especially to a card edge connector which forms a positioning mechanism for limiting transverse movement of an inserted card in the card edge connector.

DESCRIPTION OF THE PRIOR ART

U.S. Pat. Nos. 5,511,985; 5,676,555; and 5,690,499 and Taiwan Patent Application Nos. 81110052 and 84209392 disclose connectors each comprising an insulative housing defining a plurality of contact receiving cavities and a slot, a plurality of contacts, each having an engaging portion and a mounting portion, received in the cavities of the housing, and a pair of card ejector mechanisms. The housing is divided into a first part and a second part by the slot. Each part has a face from which the engaging portions of the contacts extend. The card ejector mechanisms are pivotally attached to opposite ends of the housing. When a card formed with a plurality of gold fingers on an edge thereof is inserted into the connector, the card ejector mechanisms retain the card in the slot such that the gold fingers connect with the engaging portions of the contacts. However, the slot usually has a greater dimension than a thickness of the card for facilitating insertion of the card. Thus, the edge with the gold fingers formed thereon is merely retained in the slot by the engaging portions of the contacts pressing against opposite surfaces thereof. The edge of the card is movable in the slot along a transverse direction of the housing because the contacts are made with different sizes and each contact exerts a different force on the edge of the card. The card tends to move within the slot due to shaking and vibration. Thus, the engaging portions of some of the contacts may temporarily disengaged from the gold fingers whereby intermittent signal transmission results. Hence, an improved electrical connector is required to overcome the disadvantages of the prior art.

BRIEF SUMMARY OF THE INVENTION

An object of the present invention is to provide a connector comprising a housing having a retention mechanism in a periphery of a slot defined in the housing to securely retain an edge of a card in the slot and to ensure electrical connection between contacts of the connector and gold fingers formed on the edge of the card.

Accordingly, an electrical connector for electrically connecting a card to a printed circuit board in accordance with the present invention comprises an insulative housing, a number of contacts and a pair of board locks received in the housing, and a pair of card ejector mechanisms pivotally mounted in opposite ends of the housing. The housing defines a slot which divides a middle section thereof into a first part and a second part. The first and second parts each defines a number of cavities in which the contacts are received. The first and second parts each provides a number of projections extending beyond an inner wall thereof. A gap equaling a thickness of a daughter card is defined between the projections of the first and second parts. Accordingly, the first and second projections on the first and second parts abut against opposite surfaces of the daughter card thereby securely positioning the daughter card in the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
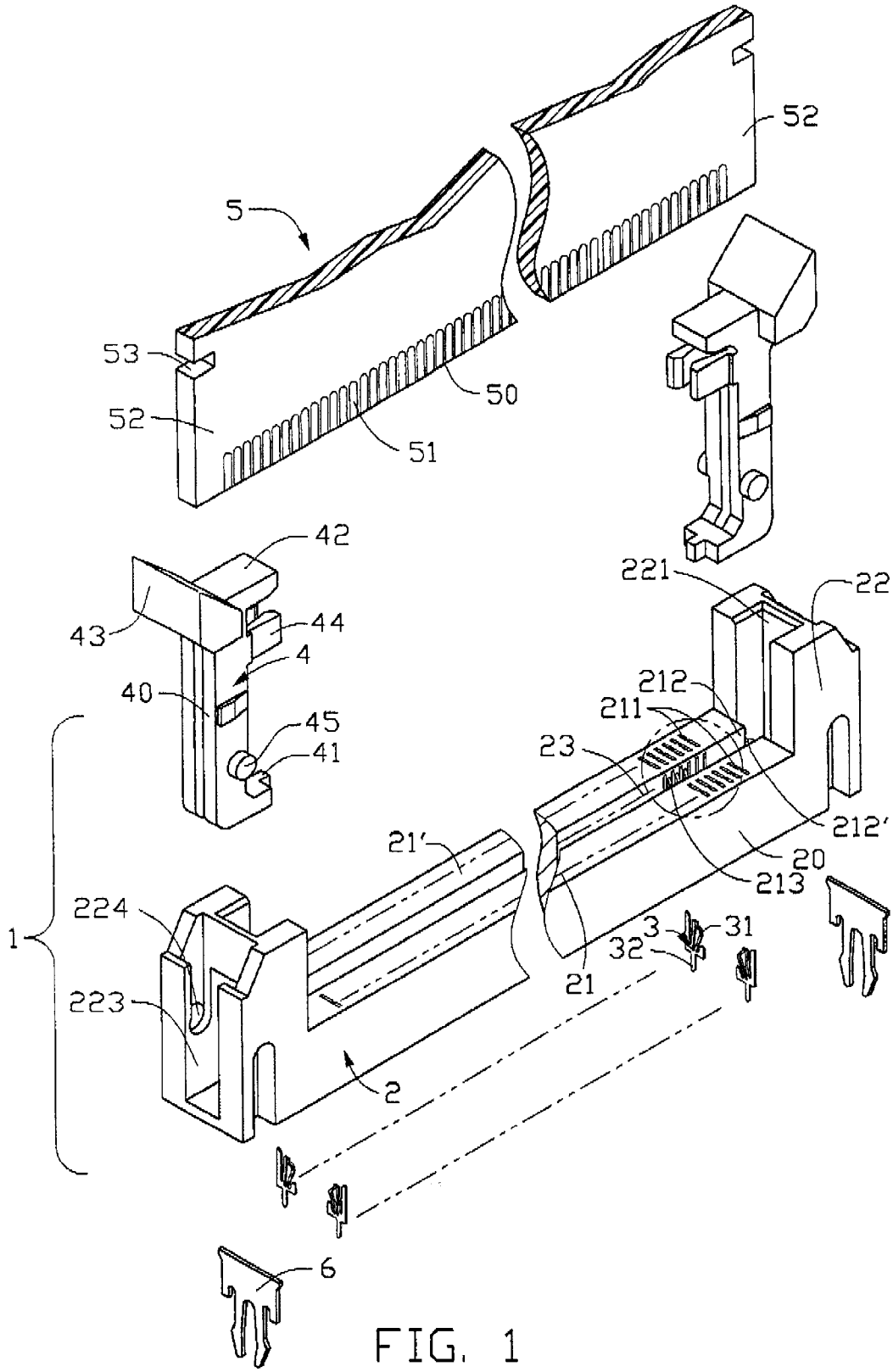
FIG. 1 is an exploded view of an electrical connector of the present invention and a card to be electrically engaged with the connector.
Figure 2:
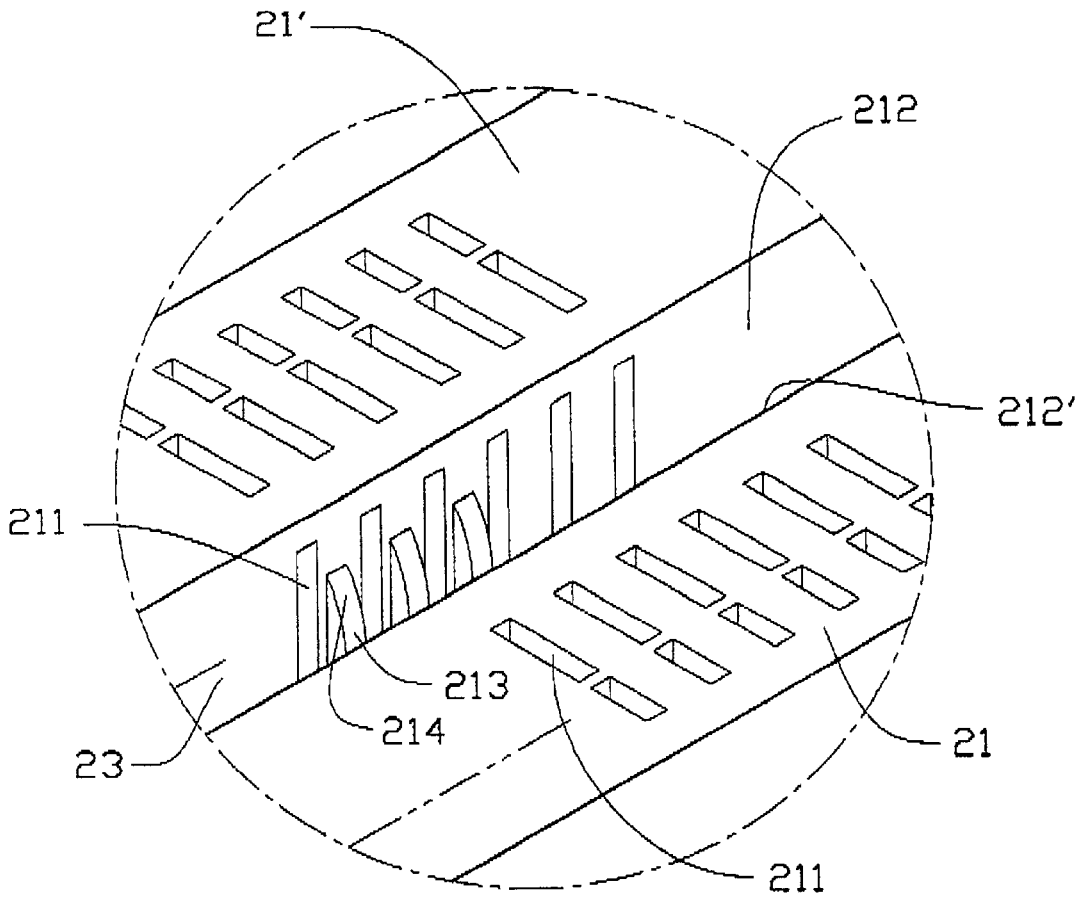
FIG. 2 is a partial, enlarged view of a housing of the connector shown in FIG. 1.

Referring to FIGS. 1 and 2, an electrical connector 1 of the present invention configured to electrically connect a daughter card 5 to a printed circuit board (not shown) comprises an insulative housing 2, a plurality of contacts 3 each comprising an engaging portion 31 and a mounting portion 32, a pair of card ejector mechanisms 4 pivotally mounted in opposite ends of the housing 2, and a pair of board locks 6. The housing 2 comprises a middle section 20 and a pair of guiding projections 22 upwardly extending from opposite ends of the middle section 20. A card receiving slot 23, generally wider than a thickness of the daughter card 5, is defined in the middle section 20 and divides the middle section 20 into first and second parts 21, 21'. Each part 21 (21') has a sufficient thickness to define a plurality of cavities 211 for accommodating the contacts 3 therein. Each guiding projection 22 defines a guiding channel 221 communicating with the slot 23 for guiding and securely positioning opposite edges 52 of the daughter card 5 and a chamber 223 in an outer edge thereof for receiving the card ejector mechanism 4. The guiding channel 221 is in communication with the chamber 223 through an opening formed in a bottom portion of the guiding projection 22. The card ejector mechanism 4 comprises a main portion 40, a flange 41 at one end of the main portion 40 and a tongue 42, a handle 43 and a pair of tabs 44 at an opposite end of the main portion 40.

Each part 21 (21') provides a plurality of equidistantly spaced projections 213 (213') (FIG. 4) extending beyond an inner wall 212 (212') thereof into the card receiving slot 23. Each projection 213 (213') downwardly extends a predetermined distance and is arranged between adjacent cavities 211. A gap equaling a thickness of a daughter card 5 is defined between the projections 213 of the first and second parts 21, 21'. A chamfer 214 is formed on an upper end of each projection 213 (213') for facilitating insertion of the daughter card 5 into the slot 23.

Figure 3:
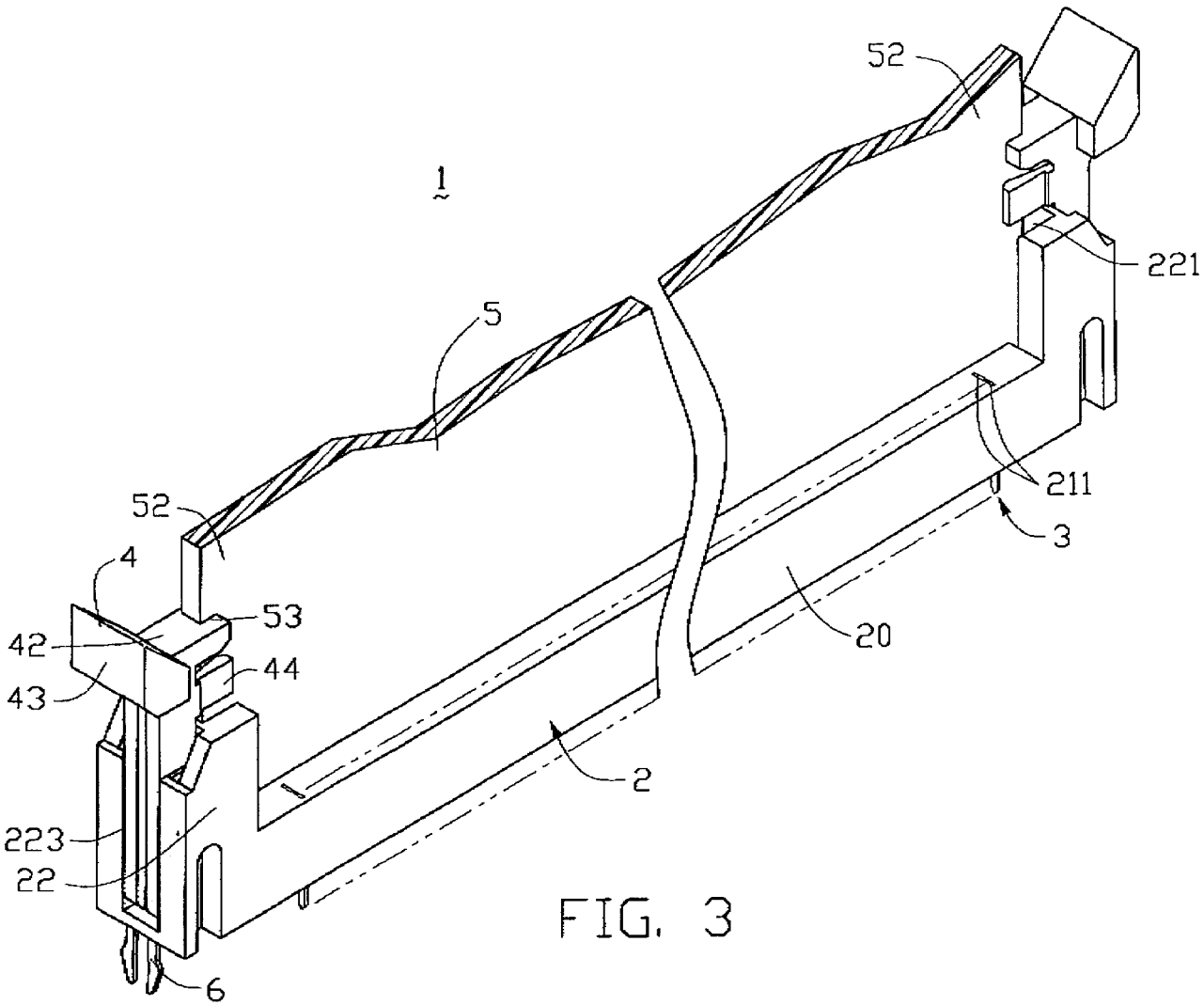
FIG. 3 is an assembled view of FIG. 1.
Figure 4:
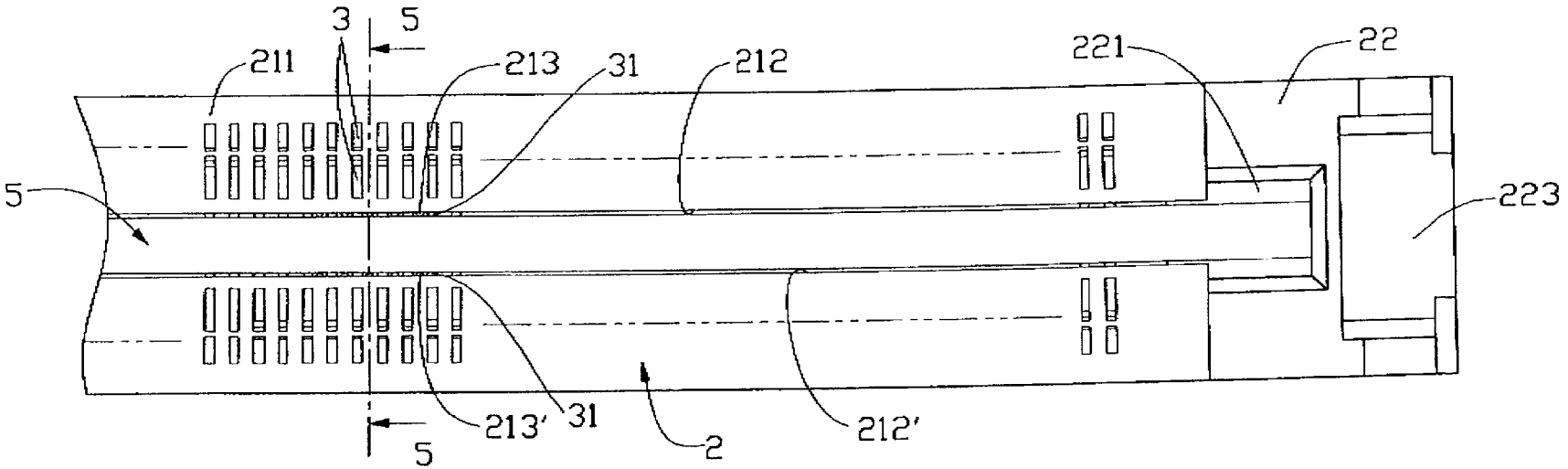
FIG. 4 is a partial, top view of FIG. 3 with a pair of card ejector mechanisms removed from the assembled connector.
Figure 5:
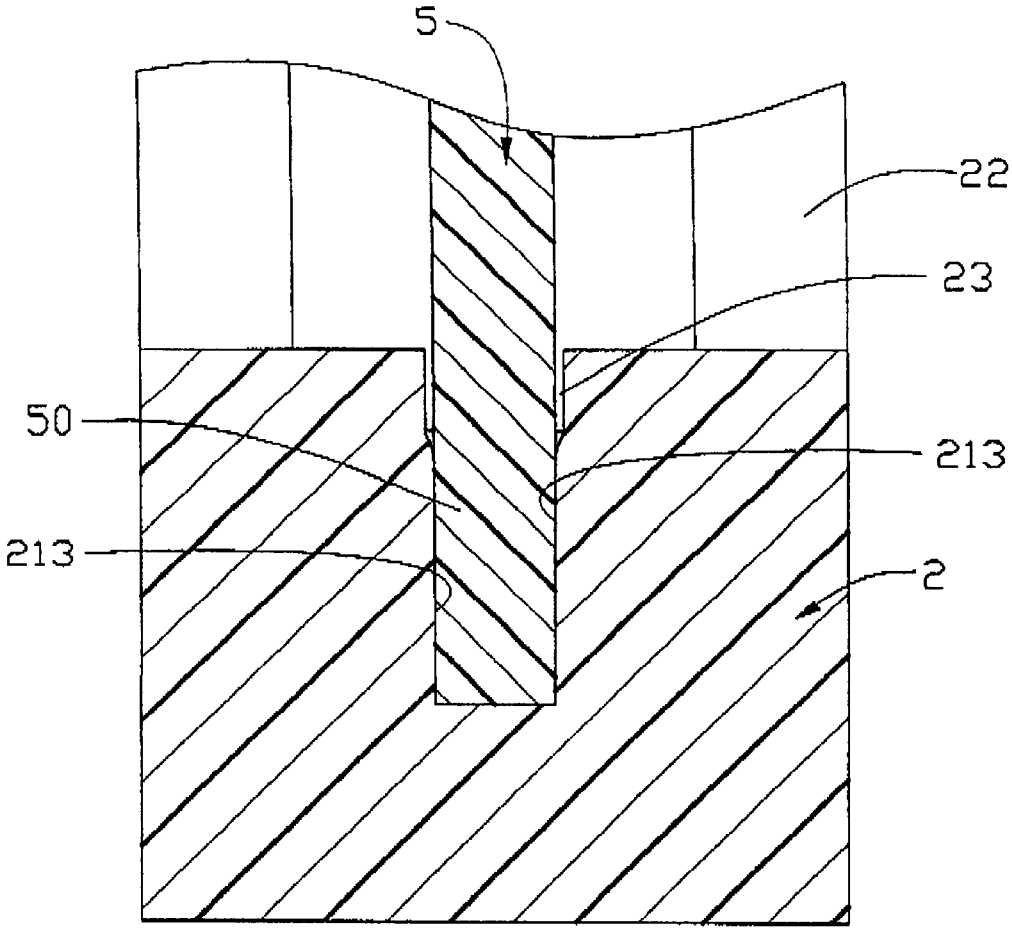
FIG. 5 is a partial cross-sectional view taken along line 5—5 of FIG. 4.

Also referring to FIGS. 3–5, in assembly, the contacts 3 and the board locks 6 are reliably received in the cavities 211 and apertures (not shown) of the housing 2, respectively, with the engaging portions 31 of the contacts 3 extending beyond the inner wall 212 (212'). Each card ejector mechanism 4 is accommodated in the chamber 223 of the corresponding guiding projection 22. A pair of pivots 45 formed on opposite sides of each card ejector mechanism 4 is received in a corresponding pair of holes 224 defined in each guiding projection 22 to pivotally attach each card ejector mechanism 4 to the housing 2. When the daughter card 5 is inserted into the connector 1, the card ejector mechanisms 4 are pushed to pivot outwardly about the holes 224 due to an external force being exerted on the handles 43. The daughter card 5 is guided into the slot 23 by the guiding channels 221 of the guiding projection 22 and the edge 50 of the daughter card 5 abuts against the engaging portions 31 of the contacts 3. The daughter card 5 is further inserted into the slot 23 and is guided by the chamfers 214 of the projections 213 (213') until the edge 50 is completely received in the slot 23. The engaging portion 31 of each contact 3 reliably connects with the corresponding gold finger 51 of the daughter card 5 and each projection 213 (213') slightly abuts against a dielectric area between adjacent gold fingers 51. The flange 41 of each card ejector mechanism 4 is downwardly pressed by opposite ends of the edge 50 resulting in an inward pivotal movement of each card ejector mechanism 4. The tabs 44 of each card ejector mechanism 4 engage opposite edges 52 of the daughter card 5 and the tongue 42 is received in a cutout 53 defined in each opposite edge 52 thereby securely retaining the daughter card 5 in the connector 1.

As seen in FIG. 5, since opposite surfaces of the edge 50 firmly abut against the projections 213, movement of the daughter card 5 in a transverse direction of the housing 2 is eliminated. Thus, the engaging portions 31 of the contacts 3 are reliably connected with the gold fingers 51 of the daughter card 5 whereby continuous transfer of electrical signals can be achieved even when the connector 1 is affected by external vibrations.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An electrical connector for interconnecting a daughter card to a printed circuit board, comprising:

a dielectric housing including a first part, a second part, a card receiving slot defined between the first and second parts, and a plurality of contact receiving cavities defined in the first and second parts, the first and second parts each having an inner wall facing toward each other, said first inner wall and said second inner wall directly facing to and communicating with said card receiving slot and commonly defining exactly only said card receiving slot therebetween;

a plurality of contacts received in the contact receiving cavities of the housing, each contact having an engaging portion and a mounting portion;

a card ejector mechanism pivotally attached to the housing; and said inner walls of the first and second parts each forming a plurality of separate projections thereon extending into the card receiving slot of the housing for limiting transverse movement of the daughter card inserted in the card receiving slot, each projection being positioned between two adjacent contact receiving cavities of the housing, each projection on the inner wall of the first part being aligned with a corresponding projection on the inner wall of the second part, and a distance from each projection on the inner wall of the first part to the corresponding aligned projection on the inner wall of the second part being substantially equal to a thickness of an edge of the daughter card, a total number of said projections being less than that of the contacts;

wherein the engaging portion of each contact and each projection respectively abut against a corresponding gold finger and a dielectric area between adjacent gold fingers of the daughter card;

wherein each projection forms a chamfer at an upper end thereof for facilitating insertion of the daughter card into the card receiving slot.

* * * * *